US005439388A

United States Patent [19]

Weiss et al.

[11] Patent Number: 5,439,388

[45] Date of Patent: * Aug. 8, 1995

[54] CORD GRIP ARRANGEMENT

[75] Inventors: Christopher J. Weiss, Cheltenham; David L. van Emmerik, Dingley, both of Australia

[73] Assignee: Alcatel Components Limited, Melbourne, Australia

[ * ] Notice: The portion of the term of this patent subsequent to Apr. 26, 2011 has been disclaimed.

[21] Appl. No.: 85,395

[22] Filed: Jun. 30, 1993

[30] Foreign Application Priority Data

Jul. 3, 1992 [AU] Australia ..... PL3338
Feb. 24, 1993 [AU] Australia ..... PL7441

[51] Int. Cl.[6] ..... H01R 4/24
[52] U.S. Cl. ..... 439/417; 439/462
[58] Field of Search ..... 439/456, 457, 459, 464, 439/469, 395, 417, 461, 462

[56] References Cited

U.S. PATENT DOCUMENTS 4,193,201 3/1980 Van Horn ..... 439/395
4,969,839 11/1990 Nilsson ..... 439/395
5,305,547 4/1994 Weiss ..... 439/395

FOREIGN PATENT DOCUMENTS 1190075 4/1965 Germany .
1378817 12/1974 United Kingdom .
2068176 8/1981 United Kingdom .

*Primary Examiner*—Gary F. Paumen
*Attorney, Agent, or Firm*—Ware, Fressola, Van der Sluys & Adolphson

[57] ABSTRACT

A cord grip arrangement for relieving mechanical strain on cord conductors (15, 16) of an electrical connector assembly comprising a first shell member (19) and a second shell member (26). The cord grip arrangement comprises a base member (1) from which two limbs (4, 5) extend to form a hinged jaw. One limb is provided with an inwardly extending protuberance (7) which co-operates with a space (8) defined by two shoulders (9, 10) in the other limb when the jaws are held closed over cable 14 by being restrained within second shell member (26) of an assembled electrical connector assembly. Such an arrangement ensures That both the outer sheath and the terminated inner conductors of the cord are securely gripped.

23 Claims, 7 Drawing Sheets

FIG. 1
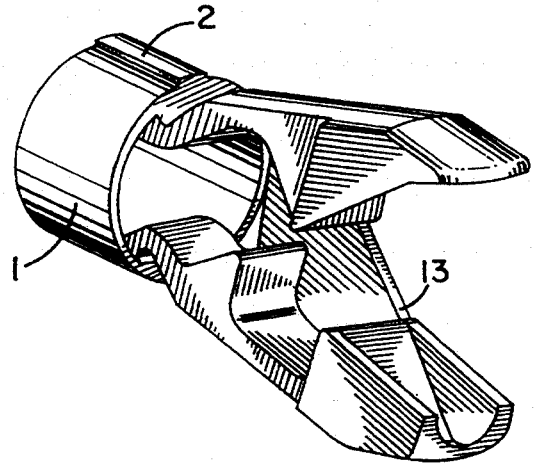
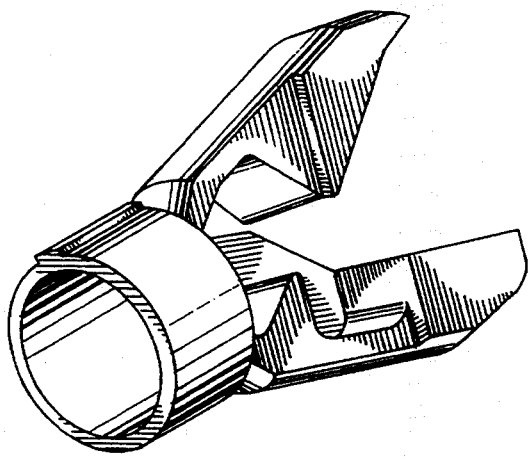
FIG. 2

FIG. 7
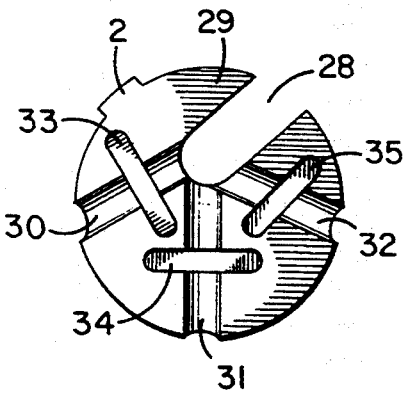
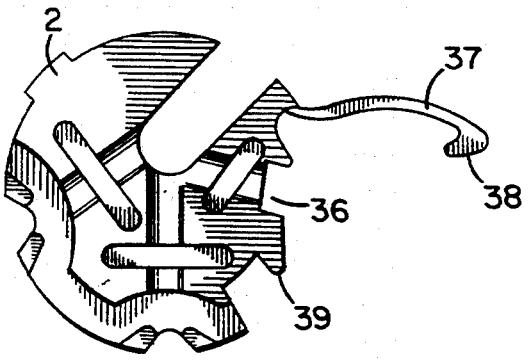
FIG. 8

CORD GRIP ARRANGEMENT

TECHNICAL FIELD

This invention relates to a cord grip arrangement for relieving mechanical strain .on cord conductors connected to contact elements of two-part coupling connectors for disconnectably interconnecting the conductors of cords such as audio cables, or disconnectably connecting the conductors of audio cables to appliances.

BACKGROUND OF THE INVENTION

A cord in the present context is defined as any small flexible cable having at least one conductor.

Cord grip arrangements are known. One such known arrangement sometimes used in the aforementioned electrical connectors is a collet arrangement which grippingly encircles the cord end.

A disadvantage of the known collet grip is that although the cord's outer sheath is securely held when under tension, the cord's inner shield and conductors are strained and tension is transferred to contact elements to which they are connected.

SUMMARY OF THE INVENTION

It is an object of the present invention to provide a grip arrangement which avoids the aforementioned disadvantage.

According to the invention there is provided a cord grip arrangement for an electrical connector element assembly of a first shell member supporting therein at least one forwardly extending contact element whose opposite end terminates in a rearwardly extending termination means, and a second shell member having a cord entrance passage, and detachably attached to the first shell member, the cord grip arrangement comprising a base member having two longitudinal limbs extending therefrom to form a pair of jaws, at least one limb being hinged by hinge means, and wherein one of the two of the limbs is provided intermediate its length with an inwardly extending protuberance opposite a space defined by two raised shoulders that extend inwardly from the other the limb, whereby when an end section of a cord having at least one exposed conductor for termination on the termination means of a detached first shell member is brought through the cord entrance and laid longitudinally between the limbs of the cord grip arrangement with the conductor/s extending towards the base member, a part of the end section of the cord spans the space such that upon holding the jaws closed with a co-operating part within said second shell member of an assembled said connector element assembly, the part of the end section of the cord is wedged between the shoulders and the protuberance.

BRIEF DESCRIPTION OF THE DRAWINGS

In order that the invention may be readily carried into effect embodiments thereof will now be described in relation to the drawings, in which:

FIG. 1 shows a first perspective of a first embodiment of the cord grip of the present invention.

FIG. 2 shows another perspective of the cord grip of FIG. 1.

FIGS. 7 and 8 show an end view of the base member of the embodiment shown in FIG. 6.

BEST MODE FOR CARRYING OUT THE INVENTION

Figure 3:
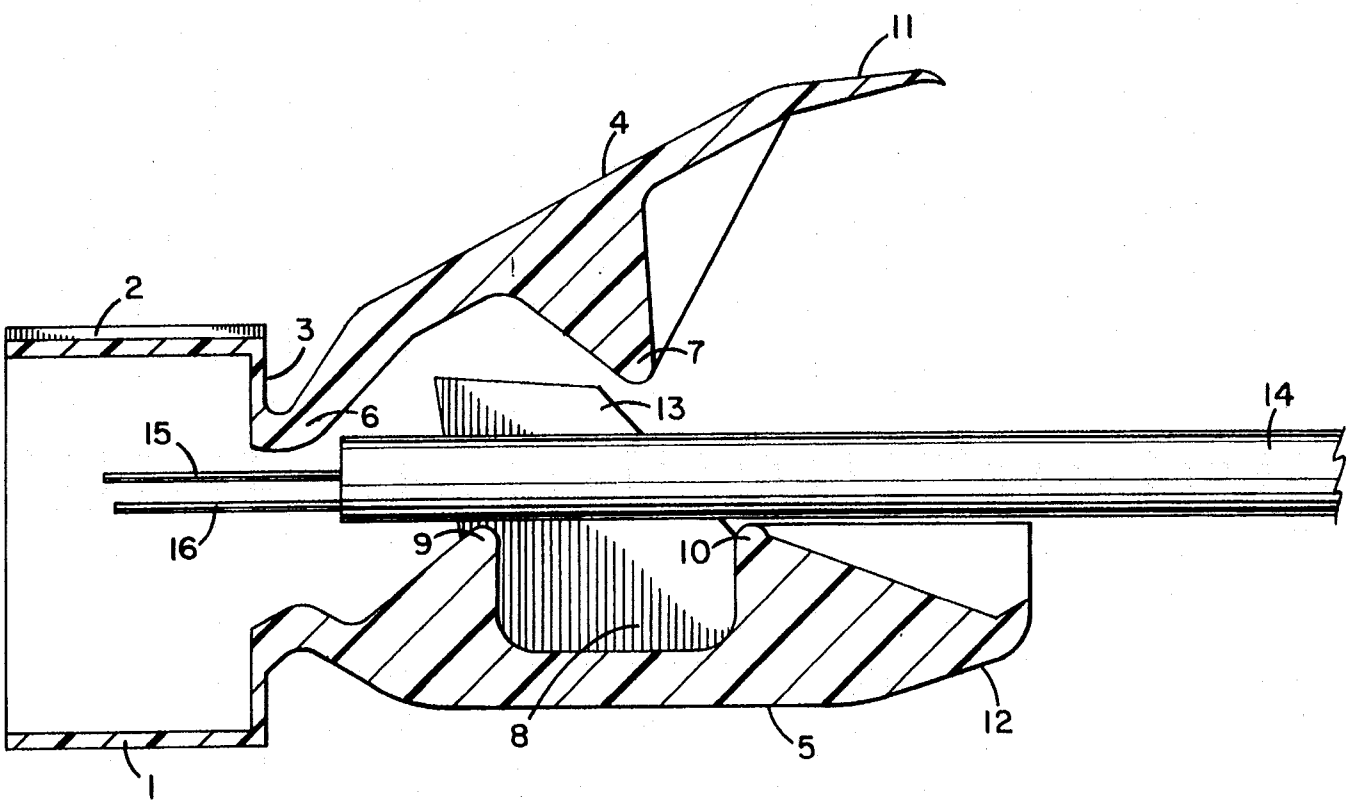
FIG. 3 shows a side view of the cord grip of FIGS. 1 and 2 in an open position prior to clamping a cord.

Referring to FIGS. 1 to 4, the cord grip comprises a base member 1 in the form of an annulus of thermo plastic material having key 2 formed on its outer surface for co-operating with a keyway.

Extending from the rear surface of base member 1 are two limbs 4 and 5 forming a pair of jaws, one of which, limb 4, being hinged by a narrow section 6; although it will be understood that both limbs may be hinged in this manner. Limb 4 is provided with an inwardly extending transverse wedge 7 whose axis is substantially normal to the longitudinal axis of limb 4. Limb 5 is provided with a transverse channel section 8 opposite the thin edge of the wedge. The two sides of channel section 8 terminate in respective shoulders 9 and 10; shoulder 10 sloping rearwardly. Limbs 4 and 5 each terminate in a section 11, 12 extending inwardly toward each other at an obtuse angle. A flat shroud 13 extends normal from one side of limb 5. The annulus of base member I may be discontinued by a slit.

Figure 4:
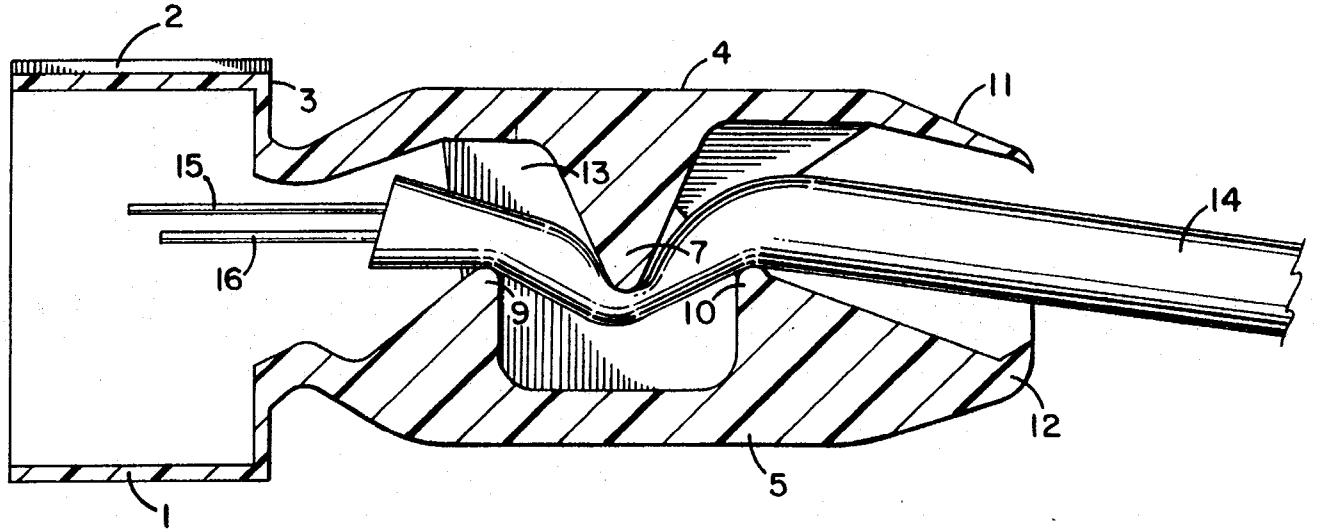
FIG. 4 shows the cord grip of FIG. 3 in a closed mode.

The basic operation of the cord grip will now be described with reference to FIGS. 3 and 4. An end of cord 14 is fed through base member 1 and insulated conductors 15 and 16 exposed. Closing the jaws causes the section of cord 14 traversing channel 8 to be bent and pinched between the thin edge of wedge 7 and shoulders 9 and 10 thereby providing a secure grip on cord 14 and conductors 15 and 16 and relieving strain in both axial directions.

Figure 5:
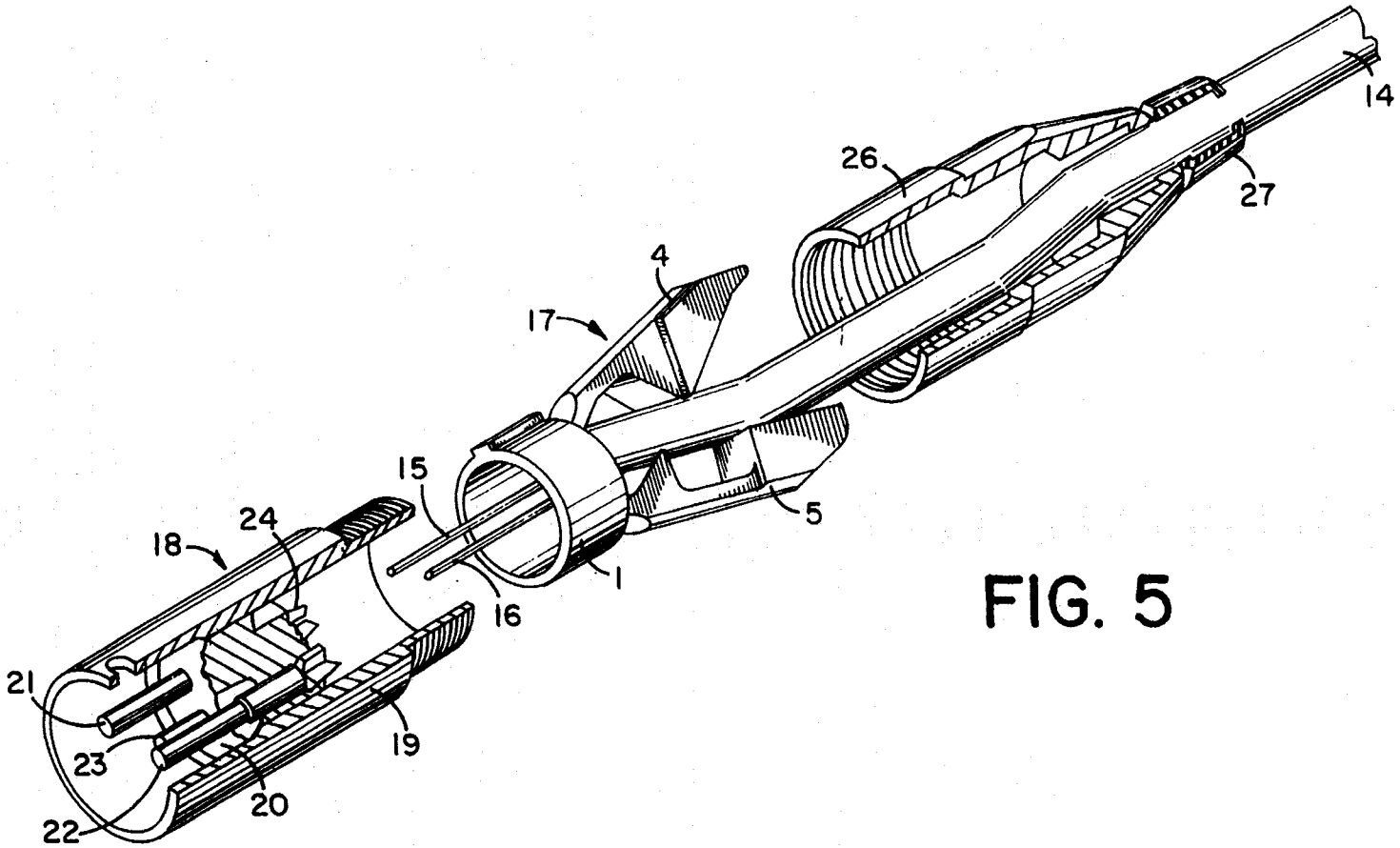
FIG. 5 is a cut-away perspective view of a coupling connector element incorporating the cord grip shown in FIGS. 1 to 4.

Referring to FIG. 5, the jaws described above are operatively arranged in a coupling connector element 17 comprising a body of circular cross-section 18 including a shell portion 19 and an insert 20, the latter being constructed of a hard plastics material or a resilient material such as, for example, rubber. An array of male contact elements 21, 22 and 23 extend outwardly from insert 20 and are fixedly supported therein. Female contact elements are also envisaged. The rear portion of each contact element protrude rearwardly through insert 20 into a space defined by the rear part of shell portion 19. Attached to the rear portion of each contact element is a rearwardly extending solderable contact, one of which, 24 is shown. Shell portion 19 is provided with a screw thread portion 25 on the outer surface of its rear end.

Connector element 17 further comprises a cylindrical outer shell 26 having a rear section in the shape of a conical frustrum through which cable 14 enters. A resilient grommet 27 is fitted to the end of the rear section.

In use, the end of cord 14 is fed through grommet 27 and a predetermined length of sheath is removed from the end of cord 14 to expose lengths of insulated conductors 15 and 16. Bared ends of conductors 15 and 16 are terminated on respective solderable contacts 24.

The jaws are closed slightly and outer shell 26 is pushed over the slightly closed jaws; base member 1 is aligned using key 2 and inserted into the space in the rear part of shell portion 19, and outer shell 26 is screwed onto shell portion 19. The axial movement of outer shell 26 causes the inner surface thereof to slidably abut sections 11 and 12 of the limbs, thereby fixing the jaws closed and gripping cord 14.

Figure 6:
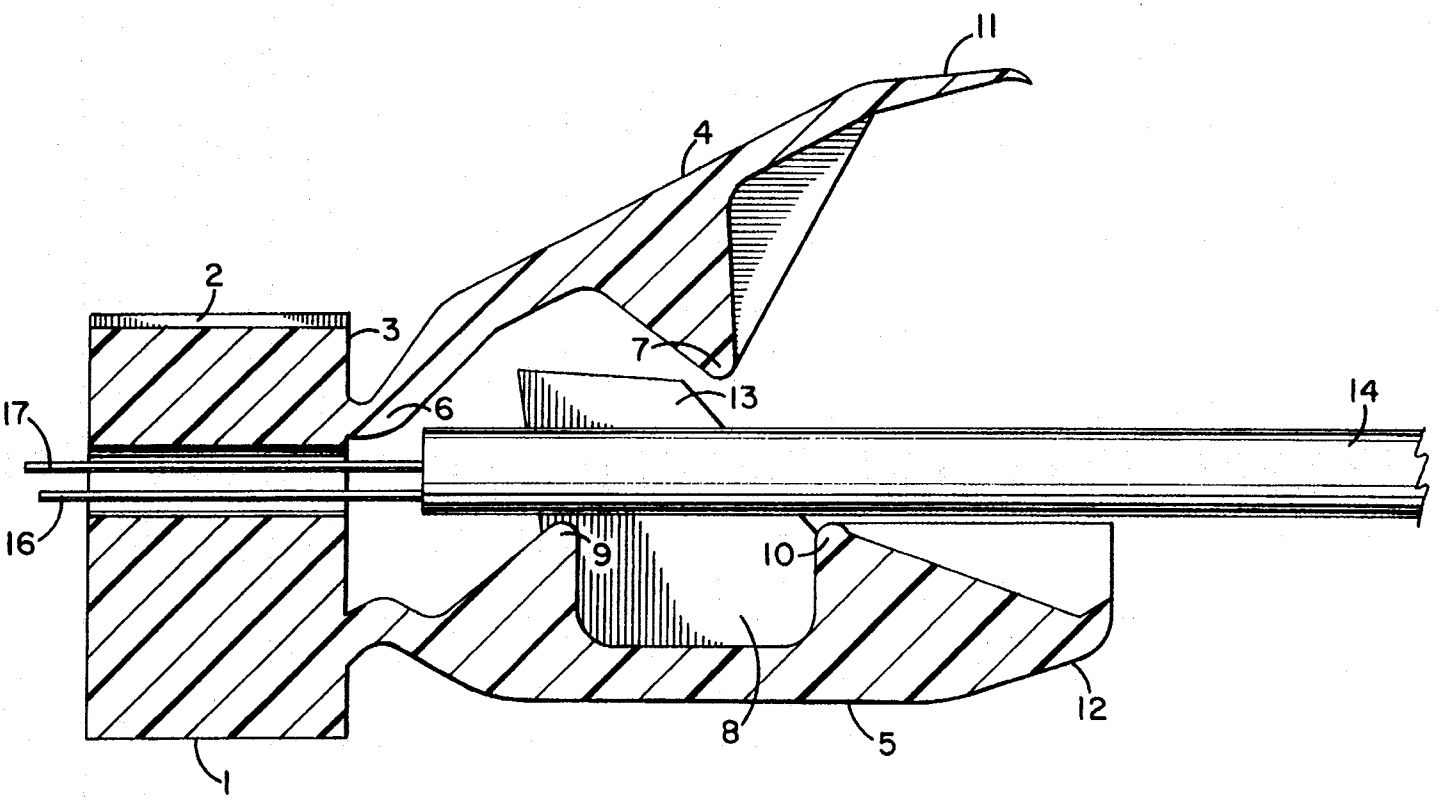
FIG. 6 shows side view of a second embodiment of the cord grip of the present invention.

The embodiment shown in FIGS. 6, 7 and 8 is similar to the one described above except that the base member I is adapted to be used in a coupling connector having insulation-penetrating contact elements. In this embodiment base member 1 is a cylindrical-shaped solid whose outer surface is provided with an axial first channel 28 for laying the insulated conductors therein so that they can pass from one side of the base member 1 to the other but remain within the boundary of the base member.

Referring to FIG. 7 the front surface 29 of base member 1 is provided with three radial second channels 30, 31 and 32, each communicating with first channel 28. Transverse each second channel is a scabbard 33, 34 and 35 for receiving insulation piecing contact elements. Preferably, base member 1 of the embodiment includes a third channel 36 (FIG. 8) for receiving therein shielding braid (not shown) which may be incorporated in cord 14 to shield insulated conductors 16 and 17. In order to avoid "hum loops" in some applications it is necessary to ensure that this shielding braid does not contact a metallic connector shell associated with the cord grip. Therefore according to the embodiment shown in FIG. 8, a cowling 37 is hingedly attached to the surface of base member 1. The said cowling 37 includes a resilient latch hook 38 which latches onto a shoulder 39. When the cowling is closed over channel 36 the twisted shielding braid is insulated from the inner wall of the metallic connector shell when the base member nests within the connector shell.

Figure 9:
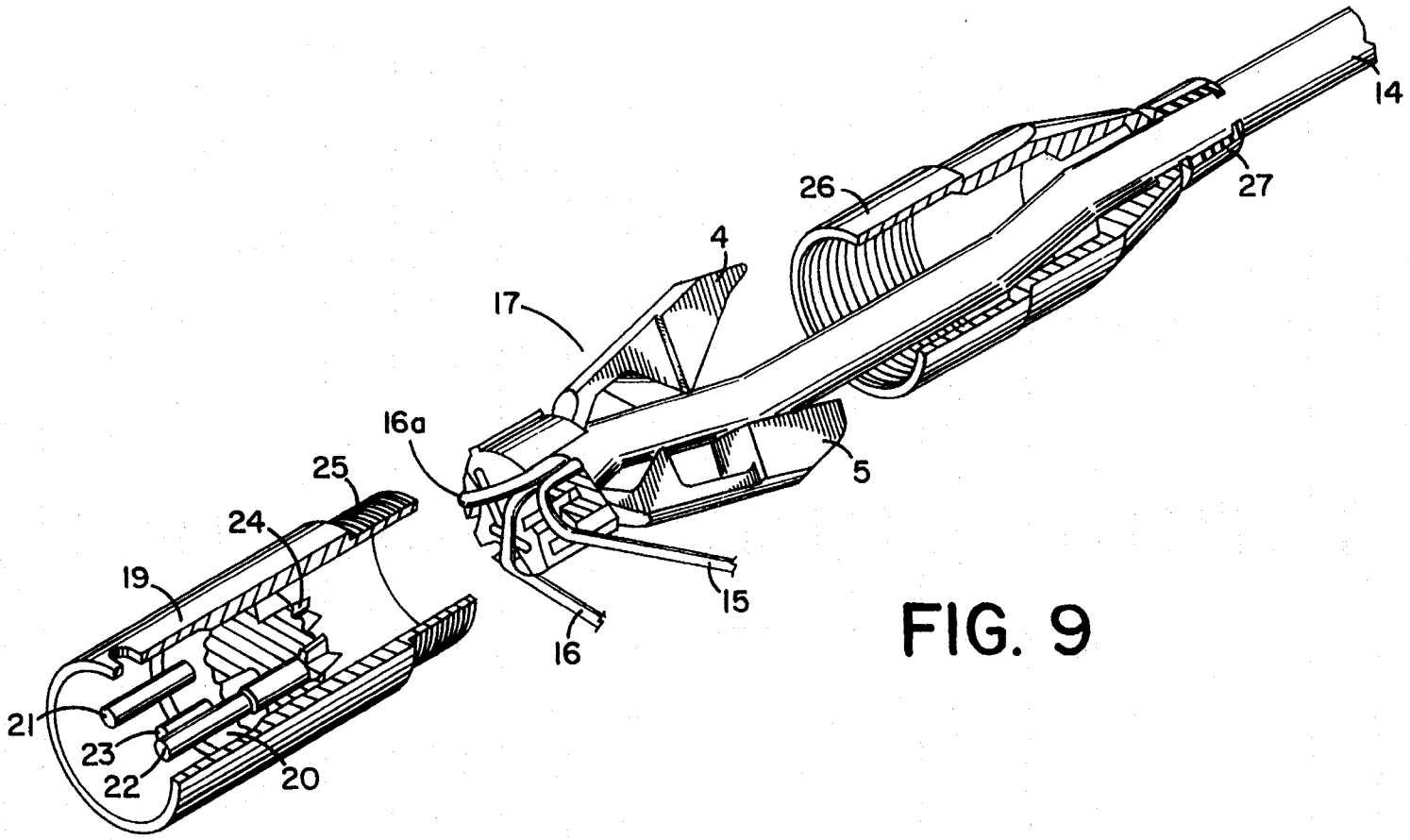
FIG. 9 shows a cut-away perspective view of an insulation-penetrating coupling connector element incorporating the cord grip shown in FIGS. 6–8.

FIG. 9 shows the lastmentioned embodiment operatively arranged in a coupling connector element similar to that described in relation to FIG. 5, except that that attached to the rear portion of each contact element is a rearwardly extending insulation-penetrating slotted plate one of which 24 is shown.

In use, and referring to FIGS. 6, 7 and 9, the end of cord 14 is fed through grommet 27 and a predetermined length of sheath is removed from the end of cord 14 to expose lengths of insulated conductors 15, 16 and **16*a* which are laid in first channel 28 and then respectively laid in second channels 30, 31 and 32 Where they are trimmed. The jaws are closed slightly and outer 26 is pushed over the slightly closed jaws; base member 1 is aligned using key 2 and inserted into the space in the rear part of shell portion 19; the insulation-penetrating slotted plates 24 enter the respective scabbards in the base member and penetrate the insulation of insulated conductors 15, 16 and 16*a*, establishing electrical contact between the conductors and the contact elements. Outer shell 26 is screwed onto shell portion 19 fixing the jaws closed as described in relation to FIG. 5**.

It will be understood that a grub screw arrangement or a tab arrangement could substitute the preferred screw thread arrangement on the connector shells.

The claims defining the invention are as follows:

1. A cord grip arrangement for an electrical connector element assembly of a first shell member supporting therein at least one forwardly extending contact element whose opposite end terminates in a rearwardly extending termination means, and a second shell member having a cord entrance passage, and detachably attached to said first shell member, said cord grip arrangement comprising a base member having two longitudinal limbs extending therefrom to form a pair of jaws, at least one limb being hinged by hinge means, and wherein one of the two said limbs is provided intermediate its length with an inwardly extending protuberance opposite a space defined by two raised shoulders that extend inwardly from the other said limb, whereby when an end section of a cord having at least one exposed conductor for termination on said termination means of a detached first shell member is brought through said cord entrance and laid longitudinally between said limbs of said cord grip arrangement with said conductor/s extending towards said base member, a part of said end section of the cord spans said space such that upon holding the jaws closed with a cooperating part within said second shell member of an assembled said connector element assembly, said part of said end section of the cord is wedged between said shoulders and said protuberance.

2. A cord grip arrangement as claimed in claim 1, wherein said protuberance is wedge-shaped whose edge lies in a plane substantially normal to the longitudinal axis of said one of the two said limbs.

3. A cord grip arrangement as claimed in claim 1, wherein said hinge means comprises a flexible section of said limb.

4. A cord grip arrangement as claimed in claim 1, wherein a section of each limb proximate their free end is bent inwardly at an obtuse angle to the remainder of the limb.

5. A cord grip arrangement as claimed in claim 1, wherein said base member and said limbs are made of thermo plastic material.

6. A cord grip arrangement as claimed in claim 5, wherein said at least one contact element comprises solderable terminal means.

7. A cord grip arrangement as claimed in claim 6, wherein said base member is an open-ended wall about a central axis defining a space through which said at least one exposed conductor can pass.

8. A cord grip arrangement as claimed in claim 7, wherein said base member is an annulus.

9. A cord grip arrangement as claimed in claim 8, wherein said annulus is discontinued by a slit.

10. A cord grip arrangement as claimed in claim 1, wherein said at least one contact element comprises an insulation-penetrating means.

11. A cord grip arrangement as claimed in claim 10, wherein said base member is a solid having a rear surface from which said longitudinal limbs extend, a side surface and a front surface, said side surface including at least one axial first channel for receiving therein said at least one exposed conductor.

12. A cord grip arrangement as claimed in claim 11, wherein said front surface includes at least one second channel which communicates with said first channel, said at least one second channel traverses a scabbard means in said front surface, said scabbard means being arranged for receiving said insulation penetrating means.

13. A cord grip arrangement as claimed in claim 11, wherein a third channel is provided in said side surface, said third channel communicating with said at least one second channel.

14. A cord grip arrangement as claimed in claim 13, wherein said side surface is provided with a hinged cowling member hingedly covering said third channel.

15. A cord grip arrangement as claimed in claim 14, wherein said cowling member includes clasp means for clasping said cowling member when closed over said third channel.

16. A cord grip arrangement as claimed in claim 15, wherein said base member is substantially cylindrical.

17. A cord grip arrangement as claimed in claim 16, wherein said first channel's bottom surface is proximate said base member's axis, said at least one second channel radiating therefrom.

18. A cord grip arrangement as claimed in claim 11, wherein said side surface of said base member includes an axial keyway.

19. A cord grip arrangement as claimed in claim 8, wherein said annulus' surface is provided with an axial keyway.

20. A cord grip arrangement as claimed in claim 1, wherein a flat shroud extends from one side of a limb, said shroud lying in a plane parallel to a plane intersecting both limbs.

21. A cord grip arrangement as claimed in claim 1, wherein said second shell is a cylinder having a rear section in the shape of a conical frustum whose narrow end forms the cord entrance passage.

22. A cord grip arrangement as claimed in claim 21, wherein said cord entrance passage is provided with a resilient grommet.

23. An electrical connector assembly of a first shell member supporting therein at least one forwardly extending contact element whose opposite end terminates in a rearwardly extending termination means, and a second shell member having a cord entrance passage detachably attached to said first shell member, including a cord grip arrangement as claimed in claim 1.

* * * * *